US006890880B2

(12) United States Patent
Yamada et al.

(10) Patent No.: US 6,890,880 B2
(45) Date of Patent: May 10, 2005

(54) HEAT-SENSITIVE RECORDING MATERIAL

(75) Inventors: Hisao Yamada, Shizuoka-ken (JP); Naoto Yanagihara, Shizuoka-ken (JP); Kazumori Minami, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 173 days.

(21) Appl. No.: 10/235,731

(22) Filed: Sep. 6, 2002

(65) Prior Publication Data

US 2003/0087758 A1 May 8, 2003

(30) Foreign Application Priority Data

Sep. 7, 2001 (JP) ..... 2001-271219

(51) Int. Cl.[7] ..... B41M 5/30

(52) U.S. Cl. ..... 503/209; 503/215; 503/216; 503/218; 503/220

(58) Field of Search ..... 503/215, 216, 503/218, 220, 209, 217

(56) References Cited

U.S. PATENT DOCUMENTS 4,876,233 A 10/1989 Saeki et al.

FOREIGN PATENT DOCUMENTS

| | | |
|---|---|---|
| DE | 3907872 A1 | 9/1989 |
| EP | 0 941 867 A1 | 9/1999 |
| JP | 1-101188 | 4/1989 |
| JP | 6-15963 | 1/1994 |
| JP | 7-246772 | 9/1995 |
| JP | 7-314904 | 12/1995 |
| JP | 8-276654 | 10/1996 |
| JP | 2000-190643 | 7/2000 |

*Primary Examiner*—Bruce Hess
(74) *Attorney, Agent, or Firm*—Sughrue Mion, PLLC

(57) ABSTRACT

A heat-sensitive recording material includes a support having disposed thereon a heat-sensitive layer including microcapsules, which contain an achromic or hypochromic electron-donating dye precursor, and a developer, wherein the microcapsules contain at least one metal compound.

18 Claims, No Drawings

HEAT-SENSITIVE RECORDING MATERIAL

BACKGROUND OF THE INVENTION

1. Field of the Invention

The present invention relates to a heat-sensitive recording material using an electron-donating dye precursor contained in microcapsules and to a developer.

2. Description of the Related Art

Heat-sensitive recording has developed in recent years because recording apparatus therefor are simple, highly reliable, and maintenance-free. Heat-sensitive recording materials that utilize the reaction between an electron-donating achromic dye and an electron-receiving compound, and heat-sensitive recording materials that utilize the reaction between a diazo salt compound and a coupler, are widely known. Extensive research has been conducted in recent years with respect to improving properties of heat-sensitive recording materials, such as (1) color development density and color development sensitivity and (2) chromogenic fastness. However, heat-sensitive recording materials have several drawbacks in terms of storage stability (resistance to heat and to light) in image areas and in non-image areas. Although various methods have been proposed to improve storage stability in image areas and in non-image areas, it is not always the case that sufficient effects are obtained.

SUMMARY OF THE INVENTION

The present invention has been devised in consideration of the aforementioned conventional problems, and attempts to achieve the following object. It is an object of the invention to provide a heat-sensitive recording material that has excellent color developing properties, and excellent fastness and resistance to light and heat in image areas.

This object is achieved by the following means.

A first aspect of the invention is a heat-sensitive recording material comprising a support having disposed thereon a heat-sensitive layer including microcapsules, which contain an achromic or a hypochromic electron-donating dye precursor, and a developer, wherein the microcapsules contain at least one metal compound.

A second aspect of the invention is the heat-sensitive recording material of the first aspect, wherein the metal compound includes at least one of a metal compound of aliphatic carboxylic acid and a metal compound of 1,3-diketone.

A third aspect of the invention is the heat-sensitive recording material of the second aspect, wherein the metal compound of aliphatic carboxylic acid includes 2 to 40 carbon atoms, and has a straight-chain structure or a branched-chain structure.

A fourth aspect of the invention is the heat-sensitive recording material of the second aspect, wherein the metal compound of 1,3-diketone is at least one selected from the group consisting of 2,4-pentadione, 3,5-heptadione, 2,2,6,6-tetramethylheptadione, 4,6-nonadione, 7,9-pentadecadione, 2,4-dimethyl-7,9-pentadecadione, 2-acetylcyclopentanone, 2-acetylcyclohexanone, 3-methyl-2,4-pentadione, 3-(2-ethylhexyl)2,4-pentadione and 3-[4-(2-ethylhexyloxy)benzyl]-2,4-pentadione.

A fifth aspect of the invention is the heat-sensitive recording material of the first aspect, wherein the metal of the metal compound is at least one selected from the group consisting of zinc, aluminum, calcium, magnesium, iron, cobalt, nickel and copper.

A sixth aspect of the invention is the heat-sensitive recording material of the first aspect, wherein the metal of the metal compound is zinc.

A seventh aspect of the invention is the heat-sensitive recording material of the first aspect, wherein the content of the metal compound in the heat-sensitive layer is from 10 to 500% by mass relative to the electron-donating dye precursor.

An eighth aspect of the invention is the heat-sensitive recording material of the first aspect, wherein the developer includes a compound indicated by general formula (1) below:

General formula (1)

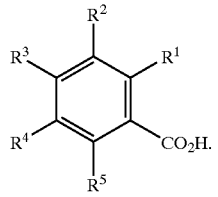

wherein $R^1$ represents a hydroxyl group or an amino group that may have a substituent; and each of $R^2$, $R^3$, $R^4$ and $R^5$ independently represents a hydrogen atom, a halogen atom, a hydroxyl group, an amino group that may have a substituent, an alkyl group, an aryl group, an alkoxy group, a carboxyl group, a carbonamide group, a sulfoneamide group, a nitro group, or a cyano group.

A ninth aspect of the invention is the heat-sensitive recording material of the first aspect, wherein the developer includes at least one selected from the group consisting of a phenol derivative, a salicylic acid derivative, an aromatic carboxylic acid derivative, acid clay, bentonite, novolak resin, metal-treated novolak resin and a metal complex.

A tenth aspect of the invention is the heat-sensitive recording material of the first aspect, wherein the content of the developer in the heat-sensitive layer is from 0.5 to 6 $g/m^2$.

An eleventh aspect of the invention is the heat-sensitive recording material of the first aspect, wherein the electron-donating dye precursor includes a compound indicated by general formula (2) below:

General formula (2)

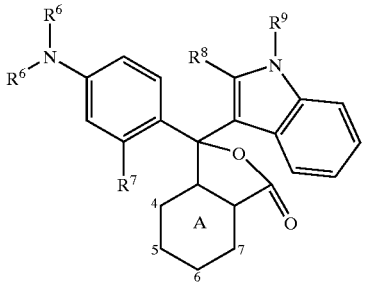

wherein $R^6$ represents an alkyl group or an aryl group; $R^7$ represents a hydrogen atom, an alkyl group, an amino group that may have a substituent, or an alkoxy group; each of $R^8$ and $R^9$ independently represents a hydrogen atom or an alkyl group; and A represents a pyridine ring in which a nitrogen atom is located at the fourth and fifth positions or at the sixth and seventh positions, or a pyrazine ring in which a nitrogen atom is located at the fourth and seventh position.

A twelfth aspect of the invention is the heat-sensitive recording material of the eleventh aspect, wherein the compound indicated in general formula (2) is a compound indicated by general formula (3) below:

General formula (3)

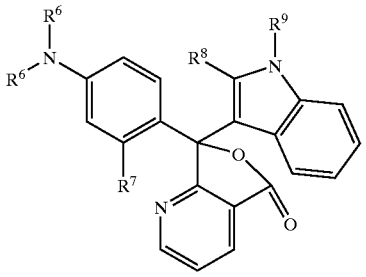

wherein $R^6$ represents an alkyl group or an aryl group; $R^7$ represents a hydrogen atom, an alkyl group, an amino group that may have a substituent, or an alkoxy group; and each of $R^8$ and $R^9$ independently represents a hydrogen atom or an alkyl group.

A thirteenth aspect of the invention is the heat-sensitive recording material of the first aspect, wherein the electron-donating dye precursor includes at least one selected from the group consisting of a triphenylmethanephthalide compound, a fluoran compound, a phenothiazine compound, an indolylphthalide compound, a leucoauramine compound, a rhodaminelactam compound, a triphenylmethane compound, a triazene compound, a spiropyran compound and a fluorene compound.

A fourteenth aspect of the invention is the heat-sensitive recording material of the first aspect, wherein the content of the electron-donating dye precursor in the heat-sensitive layer is from 0.05 to 1.0 g/$m^2$.

A fifteenth aspect of the invention is the heat-sensitive recording material of the first aspect, wherein walls of the microcapsules are formed of at least one polymer compound selected from the group consisting of polyurethane and polyurea.

A sixteenth aspect of the invention is the heat-sensitive recording material of the first aspect, further comprising an ultraviolet absorbent that includes at least one selected from the group consisting of cinnamic acid derivatives, benzophenone derivatives and benzotriazolil phenol derivatives.

A seventeenth aspect of the invention is the heat-sensitive recording material of the sixteenth aspect, wherein the added amount of the ultraviolet absorbent is from 0.05 to 1.0 g/$m^2$.

An eighteenth aspect of the invention is the heat-sensitive recording material of the first aspect, further comprising a protective layer disposed on the heat-sensitive layer.

A nineteenth aspect of the invention is the heat-sensitive recording material of the first aspect, wherein the electron-donating dye precursor includes at least a compound indicated by (A-1) below, the developer includes at least one compound indicated by (B-1) and (B-2) below, and the metal compound includes at least one selected from the group consisting of (1-1), (1-12), (1-13), (1-18) and (1-21) below.

(A-1)

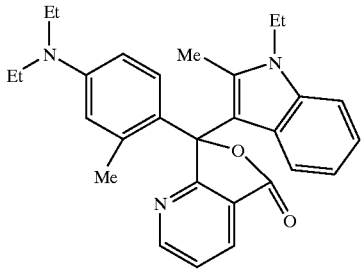

(B-1)

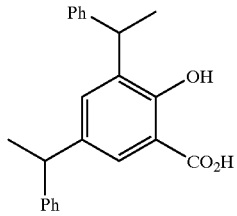

(B-2)

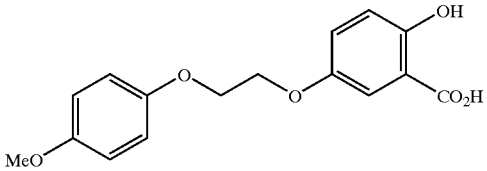

(1-1)

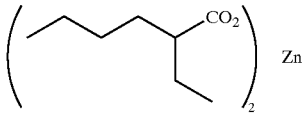

(1-12)

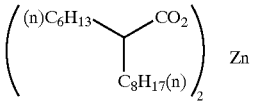

(1-13)

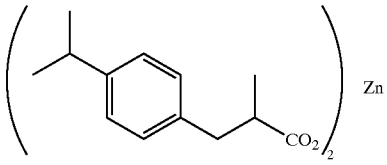

(1-18)

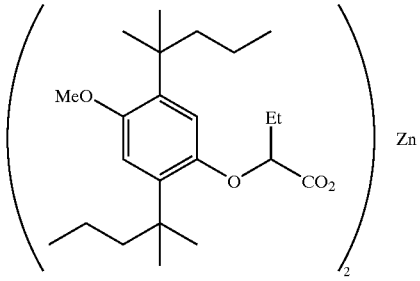

(1-21)

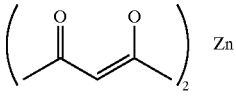

DESCRIPTION OF THE PREFERRED EMBODIMENTS

A heat-sensitive recording material of the present invention comprises a support having disposed thereon a heat-sensitive layer including microcapsules, which contain an achromic or hypochromic electron-donating dye precursor, and a developer, wherein the microcapsules contain at least one metal compound.

The metal compound is preferably at least one of a metal compound of aliphatic carboxylic acid and a metal compound of 1,3-diketone.

The aliphatic carboxylic acid may have a straight-chain structure or branched-chain structure, and preferably includes 2 to 40 carbon atoms and more preferably 6 to 25 carbon atoms. It may also have a substituent. Examples of the substituent include a phenyl group, a naphthyl group, a biphenyl group, an alkoxy group, an aryloxy group, and a halogen atom.

Examples of the 1,3-diketone include 2,4-pentadione, 3,5-heptadione, 2,2,6,6-tetramethylheptadione, 4,6-nonadione; 7,9-pentadecadione, 2,4-dimethyl-7,9-pentadecadione, 2-acetylcyclopentanone, 2-acetylcyclohexanone, 3-methyl-2,4-pentadione, 3-(2-ethylhexyl)2,4-pentadione, and 3-[4-(2-ethylhexyloxy)benzyl]-2,4-pentadione. Among these, 2,4-pentadione, 7,9-pentadecadione, and 3-[4-(2-ethylhexyloxy)benzyl]-2,4-pentadione are preferable.

The metal of the metal compound is preferably one selected from the group consisting of zinc, aluminum, calcium, magnesium, iron, cobalt, nickel and copper. Among these, zinc, aluminum and nickel are preferable, and zinc is particularly preferable.

Specific examples of the metal compound (exemplary compounds 1-1 to 1-32) are given below. However, the present invention is not limited to these examples.

(1-1)

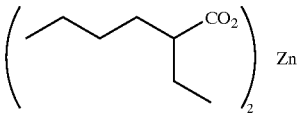

(1-2)

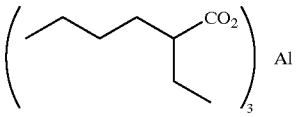

(1-3)

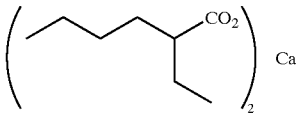

(1-4)

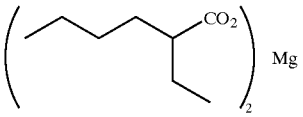

(1-5)

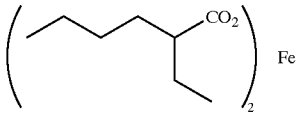

(1-6)

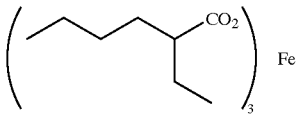

-continued (1-7)

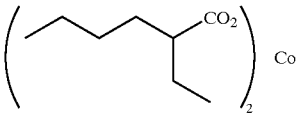

(1-8)

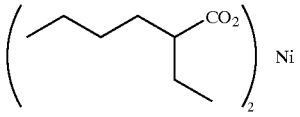

(1-9)

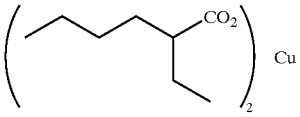

(1-10)

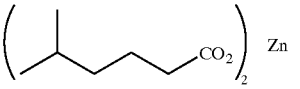

(1-11)

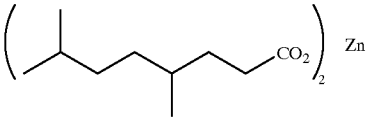

(1-12)

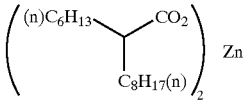

(1-13)

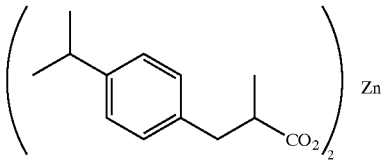

(1-14)

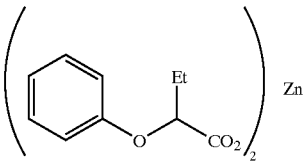

(1-15)

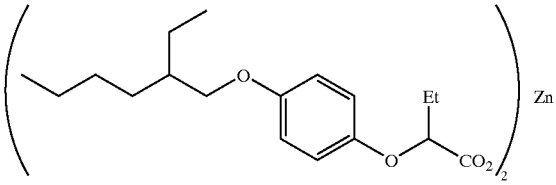

(1-16)

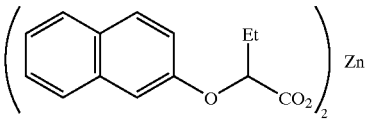

-continued (1-17)

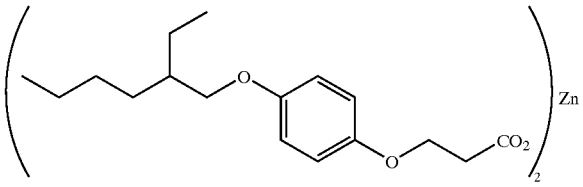

(1-18)

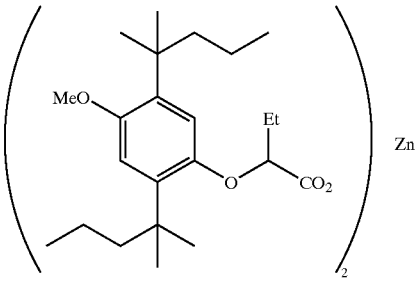

(1-19)

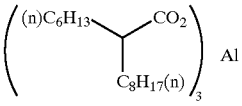

(1-20)

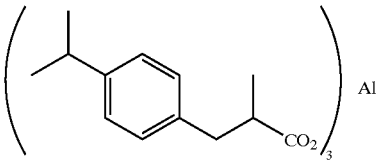

(1-21)

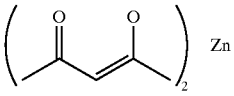

(1-22)

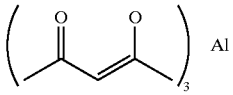

(1-23)

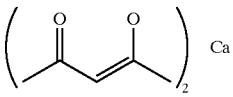

(1-24)

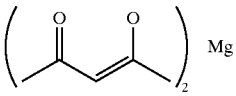

(1-25)

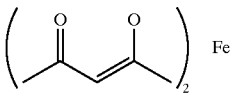

(1-26)

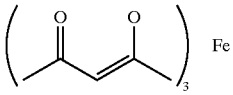

(1-27)

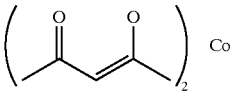

-continued (1-28)

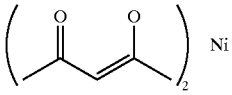

(1-29)

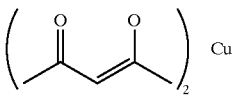

(1-30)

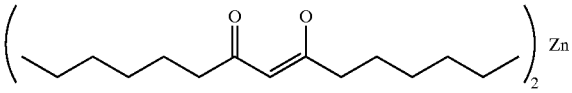

(1-31)

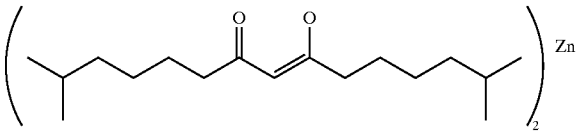

(1-32)

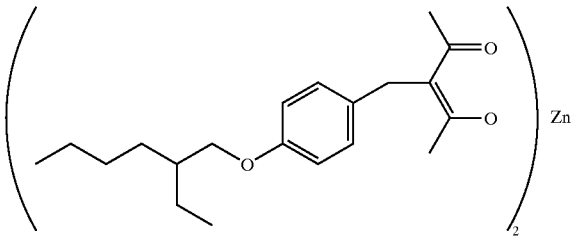

The content of the metal compound in the heat-sensitive layer is preferably from 10 to 500% by mass, and more preferably from 50 to 300% by mass, with respect to the content of the electron-donating dye precursor.

The compound indicated by general formula (1) below is preferably used as the developer.

General formula (1)

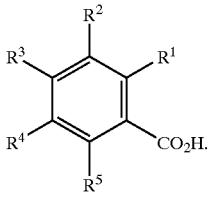

In general formula (1), $R^1$ represents a hydroxyl group or an amino group that may have a substituent; and each of $R^2$, $R^3$, $R^4$ and $R^5$ independently represents a hydrogen atom, a halogen atom, a hydroxyl group, an amino group that may have a substituent, an alkyl group, an aryl group, an alkoxy group, a carboxyl group, a carbonamide group, a sulfoneamide group, a nitro group, or a cyano group.

When the amino group represented by $R^1$ has a substituent, examples of the substituent include an acetyl group, a propanoyl group, an n-butanoyl group, an i-butanoyl group, a pivaloyl group, a 2-ethylhexanoyl group, a benzolyl group, a methoxycarbonyl group, an ethoxycarbonyl group, an n-propyloxycarbonyl group, a 2-ethylhexyloxycarbonyl group, a phenoxycarbonyl group, a methylaminocarbonyl group, an ethylaminocarbonyl group, an n-propylaminocarbonyl group, a 2-ethylhexylaminocarbonyl group, a phenylaminocarbonyl group, a dimethylaminocarbonyl group, a diethylaminocarbonyl group, a phenylthiocarbonyl group, a phenylaminothiocarbonyl group, a p-toluenesulfonylaminocarbonyl group, an ethanesulfonyl group and a benzenesulfonyl group.

The alkyl group represented by each of $R^2$, $R^3$, $R^4$ and $R^5$ may have straight-chain structure or branched-chain structure and preferably includes 1 to 12 carbon atoms.

Examples of the alkoxy group represented by each of $R^2$, $R^3$, $R^4$ and $R^5$ include a methoxy group, an ethoxy group, an n-propyloxy group, an i-propyloxy group, an n-butoxy group, an i-butoxy group, an s-butoxy group, a t-butoxy group, an n-hexyloxy group, a 2-ethylhexyloxy group, an n-octyloxy group, an n-decileoxy group, an n-dodecyloxy group, a phenoxyethoxyoxy group, and a p-methoxyphenoxyethyloxy group. Among these, a methoxy group, an ethoxy group, a 2-ethylhexyloxy group and a p-methoxyphenoxyethyloxy group are preferable.

When the amino group represented by each of $R^2$, $R^3$, $R^4$ and $R^5$ has a substituent, examples of the substituent include the same substituents of the amino group represented by $R^1$. The alkyl group represented by each of $R^2$, $R^3$, $R^4$ and $R^5$ may have straight-chain structure or branched-chain structure and preferably has 1 to 12 carbon atoms.

In addition to the compound indicated in general formula (1), conventionally known compounds of a phenol derivative, salicylic acid derivative, aromatic series carboxylic acid derivative, acid clay, bentonite, novolak resin, metal-treated novolak resin and metal complex can be used as the developer. These examples are described in detail in Japanese Patent Application Bulletin (JP-B) Nos. 40-9309 and 45-14039, and in Japanese Patent Application Laid-Open (JP-A) Nos. 48-51510, 57-210886, 58-87089, 59-11286, 60-76795 and 61-95988.

Some of these examples include 4-tertiarybutyl phenol, 4-phenyl phenol, 2,2'-dihydroxybiphenyl, 2,2-bis(4-hydroxyphenyl) propane (bisphenol A), 4,4'-sec-butylidene diphenol, 4,4'-cyclohexyliden diphenol, 4-hydroxyphenyl-3',4'dimethylphenyl sulfone, 4-(4-isopropoxyphenylsulfonyl) phenol, 4,4'-dihydroxydiphenyl sulfide, 1,4-bis-(4'-hydroxycumyl) benzene, 1,3-bis-(4'-hydroxycumyl) benzene, 4,4'-thiobis (6-tert-butyl-3-methyl phenol), 4-hydroxybenzylbenzoate ester, 3,5-di-tert-butyl salicylic acid, 3-phenyl-5-(α,α-dimethylbenzyl) salicylic acid, 3-cumyl-5-t-octyl salicylic acid, 3,5-di-t-butyl salicylic acid, 3-phenyl-5-t-octyl salicylic acid, 3-methyl-5-α-methylbenzyl salicylic acid, 3-methyl-5-cumyl salicylic acid, 3,5-di-t-octyl salicylic acid, 3,5-bis(α-methylbenzyl) salicylic acid, 3-cumyl-5-phenyl salicylic acid, 5-n-octadecyl salicylic acid, 4-pentadecyl salicylic acid, 3,5-bis (α,α-dimethylbenzyl) salicylic acid, 3,5-bis-t-octyl salicylic acid, 4-β-dodecyloxyethoxy salicylic acid, 4-methoxy-6-dodecyloxy salicylic acid, 4-β-phenoxyethoxy salicylic acid, 4-β-p-ethylphenoxyethoxy salicylic acid, 4-β-p-methoxyphenoxyethoxy salicylic acid, and metal salts thereof.

The content of the developer in the heat-sensitive layer is preferably from 0.5 to 6 g/m$^2$ and more preferably from 1 to 5 g/m$^2$.

As the electron-donating dye precursor, it is preferable to use a compound indicated by general formula (2) below.

General formula (2)

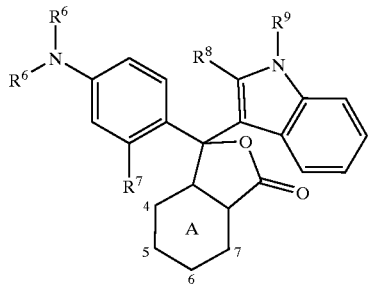

In general formula (2), $R^6$ represents an alkyl group or an aryl group; $R^7$ represents a hydrogen atom, an alkyl group, an amino group that may have a substituent, or an alkoxy group; each of $R^8$ and $R^9$ independently represents a hydrogen atom or an alkyl group; and A represents a pyridine ring in which a nitrogen atom is located at the fourth and fifth positions or at the sixth and seventh positions, or a pyrazine ring in which a nitrogen atom is located at the fourth and seventh position.

The alkyl group represented by $R^6$ may have straight-chain structure or branched-chain structure and preferably includes 1 to 12 carbon atoms.

The alkyl group represented by $R^7$ may have straight-chain structure or branched-chain structure and preferably includes 1 to 12 carbon atoms. When the amino group represented by $R^7$ has a substituent, examples of the substituent include acetyl, propanoyl, trifluoroacetyl, benzoyl, methoxycarbonyl, ethoxycarbonyl, phenoxycarbonyl, methylaminocarbonyl, ethylaminocarbonyl, phenylaminocarbonyl, dimethylaminocarbonyl, diethylaminocarbonyl, metansulfonyl and benzenesulfonyl.

The alkyl group represented by $R^8$ and $R^9$ may include straight-chain structure or branched-chain structure and preferably includes 1 to 12 carbon atoms.

Among the compounds indicated by general formula (2), it is preferable to use a compounds indicated by general formula (3) below.

General formula (3)

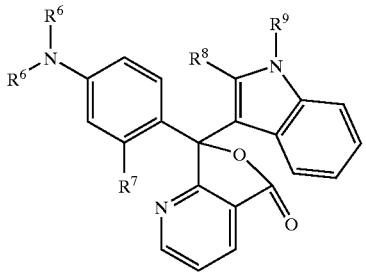

In general formula (3), $R^6$ represents an alkyl group or an aryl group; $R^7$ represents a hydrogen atom, an alkyl group, an amino group that may have a substituent, or an alkoxy group; and each of $R^8$ and $R^9$ independently represents a hydrogen atom or an alkyl group. $R^6$, $R^7$ and $R^8$ are synonymous with $R^6$, $R^7$ and $R^8$ in general formula (2).

In addition to the compounds indicated by general formulae (2) and (3), various conventionally known compounds can be utilized as the electron-donating dye precursor, such as triphenylmethane phthalide compounds, fluoran compounds, phenothiazine compounds, indolylphthalide compounds, leucoauramine compounds, rhodaminelactam compounds, triphenylmethane compounds, triazene compounds, spiropyran compounds and the fluorene compounds. Specific examples of phthalide compounds are described in U.S. Reissued Pat. No. 23024, and in U.S. Pat. Nos. 3,491,111, 3,491,112, 3,491,116 and 3,509,174. Specific examples of fluorine compounds are described in U.S. Pat. Nos. 3,624,107, 3,627,787, 3,641,011, 3,462,828, 3,681,390, 3,920,510 and 3,959,571. Specific examples of spirodipyran compounds are described in U.S. Pat. No. 3,971,808. Specific examples of pyridine and pyrazine compounds are described in U.S. Pat. Nos. 3,775,424, 3,853,869 and 4,264,318. Specific examples of fluorene compounds are described in JP-A Nos. 59-199757 and 63-41183. Examples of specific compounds include 3-(2-methyl-4-diethylaminophenyl)-3-(1-ethyl-2-methylindole-3-yl)-4-azaphthalide, 3-(2-methyl-4-dinormalhexylaminophenyl)-3-(1-normalocthyl-2-methylindole-3-yl)-4,7-diazaphthalide, 3,3-bis (2-ethoxy-4-diethylaminophenyl)-4-azaphthalide, 3,3-bis (1-normalocthyl-2-methylindole-3-yl)-4-azaphthalide, 3-(2-ethoxy-4-diethylaminophenyl)-3-(1-ethyl-2-methylindole-3-yl)-4-azaphthalide, 3-(2-ethoxy-4-diethylaminophenyl)-3-(1-normalocthyl-2-methylindole-3-yl)-phthalide, 3,3-bis(1-normalocthyl-2-methylindole-3-yl)-phthalide, 3-(2-methyl-4-diethylaminophenyl)-3-(1-normaloctyl-2-methylindole-3-yl)-phthalide, 3-(N-ethyl-N-isoamyl)-6-methyl-7-anilinofluoran, 3,6-bis (diphenylamino) fluoran, 3-dibutylamino-6-methyl-7-anilinofluoran, and 3-(N-ethyl-N-isobutyl)-6-methyl-7-anilinofluoran.

The content of the electron-donating dye precursor in the heat-sensitive layer is preferably from 0.05 to 1.0 g/m$^2$ and more preferably from 0.1 to 0.5 g/m$^2$.

The electron-donating dye precursor of the invention is used after being microencapsulated with the metal compound, and the developer of the invention is used after being solid-dispersed or emulsion-dispersed. The solid dispersion, emulsion dispersion and microencapsulation can be performed by known methods.

Although there are no limitations on how the electron-donating dye precursor and the metal compound are microencapsulated, it is preferable to employ interfacial polymerization. In interfacial polymerization, a coloring component A is dissolved or dispersed in a hydrophobic organic solvent that becomes the core of the capsules, to thereby prepare an oil phase. The prepared oil phase is mixed with an aqueous phase in which a water-soluble polymer has been dissolved, and the mixture is emulsion-dispersed by means such as a homogenizer. Thereafter, a polymer-forming reaction is caused at oil drop interfaces by heating, whereby microcapsule walls of a polymer substance are formed. This method makes it possible to form capsules having a uniform particle diameter within a short period of time, resulting in a recording material that has excellent storage stability.

In view of obtaining excellent shelf life, it is preferable that the microcapsules containing the electron-donating dye precursor and the metal compound include substantially no solvent and are produced in the following manner. A solution is prepared by dissolving, in a non-aqueous solvent having a boiling point of 40° C. to 95° C. at normal pressure, the electron-donating dye precursor and similar or different compounds that mutually react to generate a polymer substance. After emulsion-dispersing the solution in a hydrophilic protective colloid solution, the temperature of the system is increased while reducing the pressure of the reaction chamber, and the wall-forming substance is moved to the surfaces of the oil drops while removing the solvent. Wall films are formed by advancing a polymer-generating reaction resulting from polycondensation and polyaddition at the surfaces of the oil drops. The non-aqueous solvent for dissolving the electron-donating dye precursor is preferably at least one compound selected from halogenated hydrocarbon, aliphatic acid ester, ketone and ether.

In the present invention, the polymer substance that forms the walls of the microcapsules is preferably formed from at least one selected from polyurethane and polyurea. These polymer substances are respectively produced from aromatic or aliphatic isocyanate compounds as a corresponding monomer. The microcapsules containing the electron-donating dye precursor in the invention can be obtained by polymerizing the corresponding monomer. The amount of the monomer used is determined so as to produce microcapsules with an average diameter of from 0.3 to 12 $\mu$m and a wall thickness of from 0.01 to 0.3 $\mu$m.

An ultraviolet absorbent may be added to the heat-sensitive recording material of the invention in order to improve stability with respect to light. Examples thereof include cinnamic acid derivatives, benzophenone derivatives, and benzotriazolil phenol derivatives. Specific examples include $\alpha$-cyano-$\beta$-phenyl butyl cinnamate, o-benzotriazol phenol, o-benzotriazol-p-chloro phenol, o-benzotriazol-2,4-di-t-butyl phenol, and o-benzotriazol-2,4-di-t-octyl phenol. As a hindered phenol compound, phenol derivatives in which one or more of at least the 2nd or 6th position is substituted with a branched alkyl group is preferable. These ultraviolet absorbents can be utilized by being solid-dispersed, emulsion-dispersed or microencapsulated. The amount of the ultraviolet absorbent used is preferably 0.05 to 1.0 g/m$^2$ and more preferably from 0.1 to 0.4 g/m$^2$.

Known water-soluble polymer compounds and latexes can be used as the binder in the heat-sensitive recording material of the invention. Examples of water-soluble polymer compounds include methylcellulose, carboxymethylcellulose, hydroxymethylcellulose, starch, gelatin, gum arabic, casein, styrene-maleic anhydride copolymer hydrolyzed material, ethylene-maleic anhydride copolymer hydrolyzed material, polyvinyl alcohol, polyacrylamide, and modified materials thereof. Examples of latexes include styrene-butadiene rubber latex, acrylic nitrile-butadiene rubber latex, methyl acrylate-butadiene rubber latex, and vinyl acetate emulsion. The amount of these materials used is preferably from 0.4 to 5 g/m$^2$ and more preferably from 0.8 to 1.6 g/m$^2$.

Known pigments can be used as the pigment in the heat-sensitive recording material of the invention, regardless of whether the pigment is organic or inorganic. Specific examples include kaolin, calcined kaolin, talc, agalmatolite, silious earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, micro balloon, urea formalin filler, polyester particles, and cellulose filler.

Various additives can be used as needed in the heat-sensitive recording material of the invention, such as known waxes, antistatic agents, antifoaming agents, conductive materials, fluorescent dyes, surfactants, and ultraviolet absorbent precursors.

A protective layer may be disposed as needed on the surface of the heat-sensitive layer of the heat-sensitive recording material of the invention. The protective layer may comprise two or more layers as needed. Examples of materials used for the protective layer include water-soluble polymer compounds such as polyvinyl alcohol, carboxy-modified polyvinyl alcohol, vinyl acetate-acrylamide copolymer, silicon-modified polyvinyl alcohol, starch, modified starch, methyl cellulose, carboxy methyl cellulose, hydroxymethyl cellulose, gelatins, gum arabic, casein, hydrolyzed styrene-maleic acid copolymer, hydrolyzed styrene-maleic acid copolymer half ester, hydrolyzed isobutylene-maleic anhydride copolymer, polyacrylamide derivatives, polyvinyl pyrrolidone, polystyrene sodium sulfonate, sodium alginate; and latexes such as styrene-butadiene rubber latex, acrylonitrile-butadiene rubber latex, methylacrylate-butadiene rubber latex, and vinyl acetate emulsion. Storage stability can be further improved by cross-linking the water-soluble polymer compound of the protective layer, and known cross-linking agents can be used. Specific examples thereof include water-soluble initial condensation materials such as N-methylol urea, N-methylol melamine and urea-formalin; dialdehyde compounds such as glyoxal and glutaric aldehyde; inorganic cross-linking agents such as boric acid and borax; and polyamide epichlorohydrin. The protective layer may also contain known pigments, metal soaps, waxes, and surfactants. The coating amount of the protective layer is preferably from 0.2 to 5 $g/m^2$ and more preferably from 0.5 to 2 $g/m^2$. The thickness of the protective layer is preferably from 0.2 to 5 $\mu$m and more preferably from 0.5 to 2 $\mu$m.

The heat-sensitive recording material of the invention may include an ultraviolet absorbent or an ultraviolet absorbent precursor in the protective layer.

As the support usable in the heat-sensitive recording material of the invention, acid paper, acid-free paper, coated paper, plastic film laminated paper, synthetic paper, and plastic film can be used. A known undercoat layer may also be disposed on the support. The undercoat layer can be formed in the same manner as the protective layer.

A backcoat layer may be disposed in order to adjust the curl balance of the support or to improve resistance to chemicals from the back surface. It is also possible to combine a stripping paper with the backcoat layer on the back surface via an adhesive agent layer, resulting in a label. The backcoat layer can be formed in the same manner as the protective layer.

The heat-sensitive recording material is described in detail in JP-B No. 59-53193 and in JP-A Nos. 59-197463 and 62-114989.

In order to improve heat-responsiveness in the invention, a known sensitizing agent can be contained in the heat-sensitive layer. Examples thereof include aromatic ether, thioether, ester and/or aliphatic amide or ureide. These examples are described in detail in JP-A Nos. 58-57989, 58-87094, 61-58789, 62-109681, 62-132674, 63-151478 and 63-235961. The amount used is preferably from 1 to 10 $g/m^2$ and more preferably from 2 to 4 $g/m^2$.

EXAMPLES

Examples of the present invention are described below. However, the invention is not limited to these examples. Unless otherwise indicated, units are given in percent by mass.

Example 1

Manufacture of Heat-Sensitive Recording Material (Single Layer)

Preparation of Electron-Donating Dye Precursor Capsule Solution 3.0 parts of the following compound (A-1) as an electron-donating dye precursor and 3.0 parts of the exemplary compound (1-1) as a metal compound were dissolved in 20 parts of ethyl acetate. Further, 17.0 parts of alkylnaphthalene (KMC-210, manufactured by Kureha Chemical Industries Co., Ltd.), which is a high boiling point solvent, was added and mixed uniformly. 20 parts of a 3/1 adduct of xylilenediisocyanate/trimethylolpropane (75 mass percent ethyl acetate solution) (Takenate D-110N, manufactured by Takeda Pharmaceutical Co., Ltd.) as material for capsule walls was added to the obtained mixed solution and mixed uniformly.

(A-1)

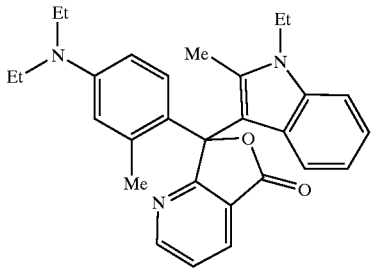

54 parts of a solution of 6% polyvinyl alcohol (polymerization degree: 1700; saponification degree: 88%) was prepared separately, the above-mentioned electron-donating dye precursor was added thereto, and then the solution was emulsion-dispersed with a homogenizer. 68 parts of water was added to the obtained emulsified solution. The solution was then made uniform and heated to 50° C. while being stirred. After a three-hour microencapsulation reaction, a target capsule solution was obtained. The average particle diameter of the capsules was 1.6 $\mu$m.

Preparation of Developer Dispersion Solution 30 parts of the following compound (B-1) was added as a developer to 150 parts of a 4% aqueous solution of polyvinyl alcohol, and the solution was then dispersed for 24 hours with a ball mill to form a dispersion solution. The average particle diameter of the developer in the resulting dispersion solution was 1.2 $\mu$m.

(B-1)

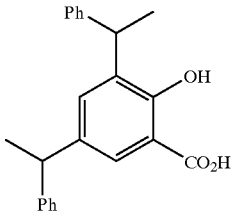

Preparation of Coating Solution

The electron-donating dye precursor capsule solution and the developer dispersion solution were mixed so that the molar ratio of the electron-donating dye precursor with respect to the developer was 1/15, whereby a target coating solution was prepared.

Coating

The coating solution was coated with a Mayer's bar onto a polyethylene terephthalate support of 75 $\mu$m in thickness and dried to obtain a target heat-sensitive recording material.

Example 2

A heat-sensitive recording material was obtained in the same manner as in Example 1, except that the metal compound (1-1) was replaced with the exemplary compound (1-12).

Example 3

A heat-sensitive recording material was obtained in the same manner as in Example 1, except that the metal compound (1-1) was replaced with the exemplary compound (1-13).

Example 4

A heat-sensitive recording material was obtained in the same manner as in Example 1, except that the metal compound (1-1) was replaced with the exemplary compound (1-18).

Example 5

A heat-sensitive recording material was obtained in the same manner as in Example 1, except that the metal compound (1-1) was replaced with the exemplary compound (1-21).

Example 6

A heat-sensitive recording material was obtained in the same manner as in Example 1, except that the metal compound (1-1) was replaced with the exemplary compound (1-12) and the developer was replaced with the following compound (B-2).

(B-2)

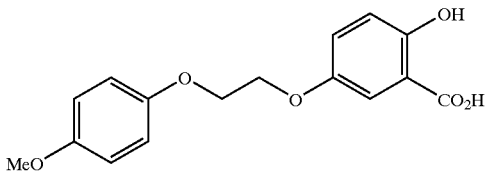

Example 7

A heat-sensitive recording material was obtained in the same manner as in Example 6, except that the metal compound (1-12) was replaced with the exemplary compound (1-21).

Comparative Example 1

A heat-sensitive recording material was obtained in the same manner as in Example 1, except that the metal compound was not used.

Comparative Example 2

A heat-sensitive recording material was obtained in the same manner as in Example 1, except that the metal compound was not used and the developer (B-1) was replaced with the following compound (B-3).

(B-3)

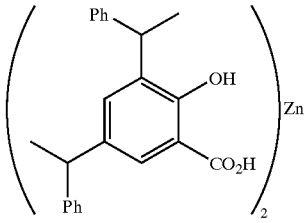

Evaluation (Color Development Density)

Image density D0 in respective color-developed areas was measured with a Macbeth densitometer. The results are shown in Table 1. The higher the value of D0 is, the higher sensitivity of the heat-sensitive recording paper was.

(Light-Resistance in Image Area Experiment)

Image density D1 was measured with a Macbeth reflection densitometer after irradiating, using a xenon fademeter (FAL-25AX-HC, manufactured by Suga Test Instruments Co., Ltd.), with light for 48 hours an image area obtained by printing. The light resistance in the image area is shown in Table 1 as the residual ratio of the image after being irradiated with light, wherein the residual ratio=(D1/D0)×100%. The larger the residual ratio is, the better light resistance in the image area was.

TABLE 1

| | Electron-Donating Dye Precursor | Developer | Metal Compound | Color Development Density | Light Resistance in Image Area |
|---|---|---|---|---|---|
| Example 1 | (A-1) | (B-1) | (1-1) | 1.41 | 75 |
| Example 2 | (A-1) | (B-1) | (1-12) | 1.48 | 77 |
| Example 3 | (A-1) | (B-1) | (1-13) | 1.52 | 78 |
| Example 4 | (A-1) | (B-1) | (1-18) | 1.47 | 72 |
| Example 5 | (A-1) | (B-1) | (1-21) | 1.56 | 80 |
| Example 6 | (A-1) | (B-2) | (1-12) | 1.35 | 70 |
| Example 7 | (A-1) | (B-2) | (1-21) | 1.43 | 75 |
| Comp. Ex. 1 | (A-1) | (B-1) | — | 1.05 | 45 |
| Comp. Ex. 2 | (A-1) | (B-3) | — | 0.45 | 70 |

According to the present invention, a heat-sensitive recording material that has excellent color developing properties, and excellent fastness and resistance to light and heat in image areas can be provided.

What is claimed is:

1. A heat-sensitive recording material comprising a support having disposed thereon a heat-sensitive layer including microcapsules, which contain an achromic or a hypochromic electron-donating dye precursor, and a developer, wherein the microcapsules contain at least one metal compound, wherein the metal compound includes at least one of a metal compound of aliphatic carboxylic acid and a metal compound of 1,3-diketone.

2. The heat-sensitive recording material according to claim 1, wherein the metal compound of aliphatic carboxylic acid includes 2 to 40 carbon atoms, and has a straight-chain structure or a branched-chain structure.

3. The heat-sensitive recording material according to claim 1, wherein the metal compound of 1,3-diketone is at least one selected from the group consisting of 2,4-pentadione, 3,5-heptadione, 2,2,6,6-tetramethylheptadione, 4,6-nonadione, 7,9-pentadecadione, 2,4-dimethyl-7,9-pentadecadione, 2-acetylcyclopentanone, 2-acetylcyclohexanone, 3-methyl-2,4-pentadione, 3-(2-ethylhexyl)2,4-pentadione and 3-[4-(2-ethylhexyloxy) benzyl]-2,4pentadione.

4. The heat-sensitive recording material according to claim 1, wherein the metal of the metal compound is at least one selected from the group consisting of zinc, aluminum, calcium, magnesium, iron, cobalt, nickel and copper.

5. The heat-sensitive recording material according to claim 1, wherein the metal of the metal compound is zinc.

6. The heat-sensitive recording material according to claim 1, wherein the content of the metal compound in the heat-sensitive layer is from 10 to 500% by mass relative to the electron-donating dye precursor.

7. The heat-sensitive recording material according to claim 1, wherein the developer includes a compound indicated by general formula (1) below:

General formula (1)

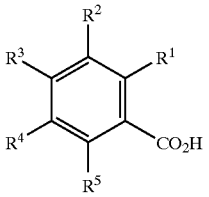

wherein $R^1$ represents a hydroxyl group or an amino group that may have a substituent; and each of $R^2$, $R^3$, $R^4$ and $R^5$ independently represents a hydrogen atom, a halogen atom, a hydroxyl group, an amino group that may have a substituent, an alkyl group, an aryl group, an alkoxy group, a carboxyl group, a carbonamide group, a sulfoneamide group, a nitro group, or a cyano group.

8. The heat-sensitive recording material according to claim 1, wherein the developer includes at least one selected from the group consisting of a phenol derivative, a salicylic acid derivative, an aromatic carboxylic acid derivative, acid clay, bentonite, novolak resin, metal-treated novolak resin and a metal complex.

9. The heat-sensitive recording material according to claim 1, wherein the content of the developer in the heat-sensitive layer is from 0.5 to 6 g/m$^2$.

10. The heat-sensitive recording material according to claim 1, wherein the electron-donating dye precursor includes a compound indicated by general formula (2) below:

General formula (2)

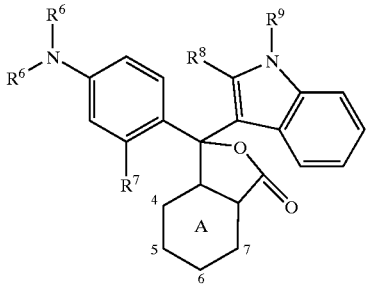

wherein $R^6$ represents an alkyl group or an aryl group; $R^7$ represents a hydrogen atom, an alkyl group, an amino group that may have a substituent, or an alkoxy group; each of $R^8$ and $R^9$ independently represents a hydrogen atom or an alkyl group; and A represents a pyridine ring in which a nitrogen atom is located at the fourth and fifth positions or at the sixth and seventh positions, or a pyrazine ring in which a nitrogen atom is located at the fourth and seventh position.

11. The heat-sensitive recording material according to claim 10, wherein the compound indicated in general formula (2) is a compound indicated by general formula (3) below:

General formula (3)

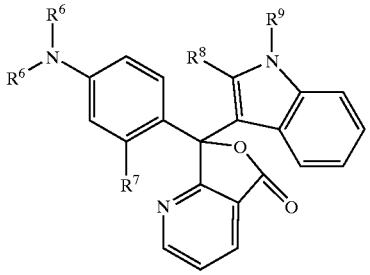

wherein $R^6$ represents an alkyl group or an aryl group; $R^7$ represents a hydrogen atom, an alkyl group, an amino group that may have a substituent, or an alkoxy group; and each of $R^8$ and $R^9$ independently represents a hydrogen atom or an alkyl group.

12. The heat-sensitive recording material according to claim 1, wherein the electron-donating dye precursor includes at least one selected from the group consisting of a triphenylmethanephthalide compound, a fluoran compound, a phenothiazine compound, a indolylphthalide compound, a leucoauramine compound, a rhodaminelactam compound, a triphenylmethane compound, a triazene compound, a spiropyran compound and a fluorene compound.

13. The heat-sensitive recording material according to claim 1, wherein the content of the electron-donating dye precursor in the heat-sensitive layer is from 0.05 to 1.0 g/m$^2$.

14. The heat-sensitive recording material according to claim 1, wherein walls of the microcapsules are formed of at least one polymer compound selected from the group consisting of polyurethane and polyurea.

15. The heat-sensitive recording material according to claim 1, further comprising an ultraviolet absorbent that includes at least one selected from the group consisting of cinnamic acid derivatives, benzophenone derivatives and benzotriazolil phenol derivatives.

16. The heat-sensitive recording material according to claim 15, wherein the added amount of the ultraviolet absorbent is from 0.05 to 1.0 g/m$^2$.

17. The heat-sensitive recording material according to claim 1, further comprising a protective layer disposed on the heat-sensitive layer.

18. The heat-sensitive recording material according to claim 1, wherein the electron-donating dye precursor includes at least a compound indicated by (A-1) below, the developer includes at least one compound indicated by (B-1) and (B-2) below, and the metal compound includes at least one selected from the group consisting of (1—1), (1-12), (1-13), (1-18) and (1-21) below:

(A-1)

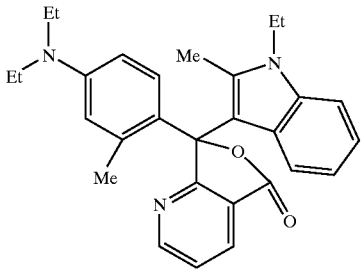

(B-1)

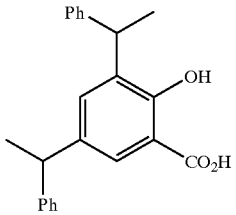

-continued (B-2)

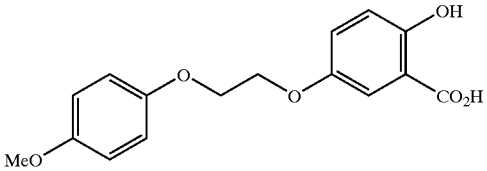

(1-1)

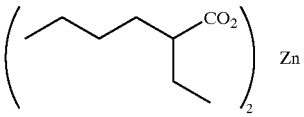

(1-12)

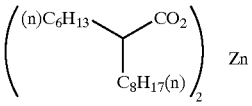

(1-13)

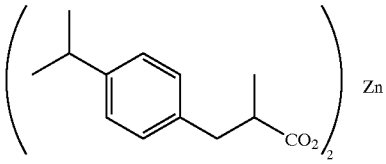

* * * * *